US005140971A

United States Patent [19]

Heffer

[11] Patent Number: 5,140,971

[45] Date of Patent: Aug. 25, 1992

[54] THROWING ARM AND MAGAZINE FOR A TARGET THROWING DEVICE

[76] Inventor: Brian A. Heffer, Lawson Road, Barham, New South Wales, 2739, Australia

[21] Appl. No.: 595,124

[22] Filed: Oct. 10, 1990

Related U.S. Application Data

[63] Continuation-in-part of Ser. No. 542,684, Jun. 25, 1990, Pat. No. 5,036,828, which is a continuation of Ser. No. 35,733, Mar. 26, 1987, abandoned.

[30] Foreign Application Priority Data

Oct. 11, 1989 [AU] Australia ..... PJ6782

[51] Int. Cl.[5] ..... F41B 3/04; F41J 9/18

[52] U.S. Cl. ..... 124/8; 124/43; 124/47

[58] Field of Search ..... 124/5-8, 124/45-48, 42, 43, 4, 9, 1, 81; 273/364; 221/242, 241

[56] References Cited

U.S. PATENT DOCUMENTS

| | | | |
|---|---|---|---|
| 346,988 | 8/1886 | Curran | 124/8 |
| 1,607,874 | 11/1926 | Darton | 124/5 |
| 2,310,746 | 2/1943 | Parker et al. . | |
| 2,711,726 | 6/1955 | Darrell . | |
| 2,827,036 | 3/1958 | Ervine et al. . | |
| 2,928,383 | 3/1960 | Ohlson | 124/8 |
| 3,179,101 | 4/1965 | Luebkeman | 124/8 |
| 3,351,232 | 11/1967 | Anderson . | |
| 3,368,542 | 2/1968 | Dale | 124/8 |
| 3,621,828 | 11/1971 | Hansen | 124/8 |
| 3,937,203 | 2/1976 | Riedmueller et al. . | |
| 4,005,695 | 2/1977 | Alday et al. . | |
| 4,481,932 | 11/1984 | Olson | 124/8 |
| 4,558,802 | 12/1985 | Molison . | |
| 4,974,574 | 12/1990 | Cutlep | 124/5 |

FOREIGN PATENT DOCUMENTS

| | | | |
|---|---|---|---|
| 2952527 | 7/1981 | Fed. Rep. of Germany . | |
| 2334081 | 7/1977 | France . | |
| 2419500 | 11/1979 | France . | |
| 2587472 | 3/1987 | France | 124/43 |
| 1337212 | 11/1973 | United Kingdom | 124/8 |

*Primary Examiner*—Peter M. Cuomo
*Attorney, Agent, or Firm*—Lowe, Price, LeBlanc & Becker

[57] ABSTRACT

A throwing arm for a target throwing device the arm including upper and lower plates which receive respective targets so that in operation two targets are thrown simultaneously. The arm is formed as an extrusion for strength lightness and ease of fabrication. A novel magazine is also disclosed which utilizes extruded elements which are shaped and disposed so as to hold targets in columns in the magazine.

9 Claims, 7 Drawing Sheets

16
20
20
20
20
18
18
18

12
2
8
10
14
6
4

THROWING ARM AND MAGAZINE FOR A TARGET THROWING DEVICE

This application is a continuation-in-part of Ser. No. 542,684 filed Jun. 25, 1990, now U.S. Pat. No. 5,036,828, which is a continuation of Ser. No. 035,733 filed Mar. 26, 1987, now abandoned.

This invention relates to a throwing arm for a target throwing device.

Target throwing devices of many types are well known in the art. See for instance U.S. Pat. Nos. 2,711,726 and 4,005,695 and U.S. patent application Ser. No. 542,684 filed Jun. 25, 1990. The content of the latter document is incorporated herein by cross-reference. Most of the known devices have a mechanism which rotates a throwing arm to eject disk shaped clay targets therefrom. The throwing arm normally comprises an elongate plate like member mounted, adjacent to one end, on a shaft which is rapidly rotated by the throwing mechanism. The trailing edge of the arm normally includes a support for a hard rubber strip which frictionally bears against the sides of the targets. When the throwing arm is rapidly rotated, the targets move along the arm and the friction member imparts a rolling motion so that when the targets are flung from the end of the arm, they will spin through the air with the correct trajectory.

An object of the present invention is to provide a novel arm which is capable of simultaneously ejecting two or more targets.

According to the present invention there is provided a throwing arm for a target throwing device, said arm including a first surface for supporting a first target thereon, a first friction member extending above the first surface for frictionally engaging, in use, the side of the first target, a second surface for supporting a second target thereon, a second friction member extending above the second surface for frictionally engaging, in use, the side of the first target, characterised in that the first and second surfaces are integrally formed.

Preferably, the first and second friction members are held captive in first and second recesses respectively and wherein the recesses are also integrally formed with the first and second surfaces.

Preferably further, the first and second surfaces are interconnected by means of a wall member which extends therebetween and wherein said grooves are formed into said wall member.

Preferably further, the first and second surfaces comprise the upper surfaces of first and second plates which project from the wall member. It is further preferred that the outer regions of the plates are of thinner thickness than the inner regions adjacent to the wall member. It is still further preferred that the edges of the plates are formed with beads.

Another object of the invention is to provide a novel form of target magazine for use in a target throwing device.

According to the present invention there is provided a magazine for a target throwing device comprising:

a plurality of support elements arranged in a ring for supporting columns of targets; and means for supporting said elements in said ring and for rotation in unison about an axis which passes through the centre of the ring, characterised in that the elements comprise extruded elements.

Preferably said elements includes a first pair of legs which substantially lie on an imaginary cylindrical surface which is substantially the same diameter as the targets and a second pair of legs which substantially lie on a different imaginary cylindrical surface which is substantially the same diameter as the targets and wherein said means for supporting said elements maintains the positions of the elements such that the each column of targets is, in use, supported by the first pair of legs of one support element and the second pair of legs of an adjacent support element.

It will be appreciated that the magazine can be very easily fabricated since it may comprise a plurality of arms radiating from a hub and a plurality of upright members extending from the respective bars. The extruded elements interlock with the bars. The columns of targets are held between adjacent extruded elements. The bars are arranged in a ring so that the columns of targets are also arranged in a ring.

Preferably further, adaptors may be provided to interlock with the legs of the extruded elements, the adaptors including curved portions which are arranged to engage columns of targets of smaller diameter. This enables greater flexibility of the use of the magazine because different size targets can be used.

The magazine can readily be used with the target thrower disclosed in the aforementioned U.S. patent application.

The invention will now be further described with reference to the accompanying drawings in which.

Figure 1:
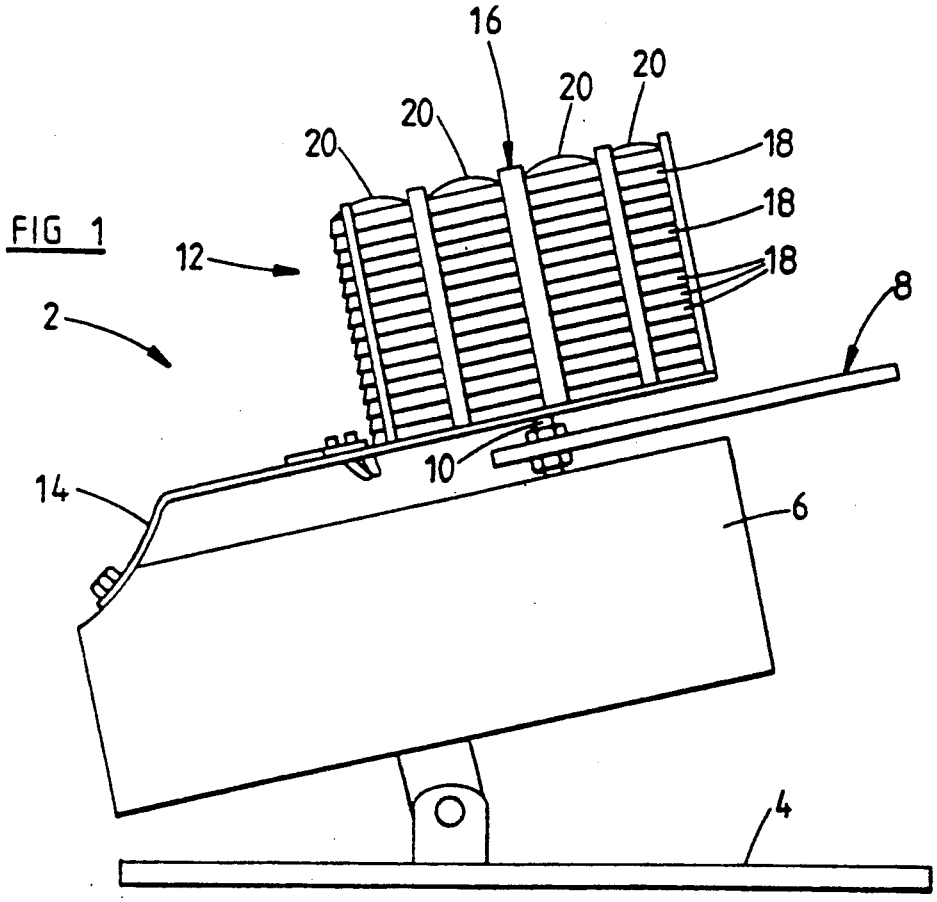
FIG. 1 is a simplified view of a target throwing device.

The throwing apparatus 2 shown in FIG. 1 comprises a base 4 which mounts a throwing mechanism 6 having a throwing arm 8 mounted for rotation with a shaft 10. The mechanical details of the throwing mechanism 6 are well known in the art and need not be described in detail. The illustrated arrangement shows a magazine 12 mounted above the mechanism 6 by means of a bracket 14. The magazine is also not essential because the targets 20 can be manually placed on the arm 8. The magazine includes a cage structure 16 which holds the clay pigeons or targets 18 in a plurality of columns 20. In use of the apparatus, the mechanism 6 rotates the arm and during part of the cycle of rotation of the arm 8 one of the clay pigeons 18 is transferred to the arm. The arm then comes to rest until triggered by the user and a rapid throwing stroke is executed. The target rolls along the arm 8 and at the end thereof the target will be projected from the device. A new target can then be delivered to the arm in readiness for the next triggering.

Figure 3:
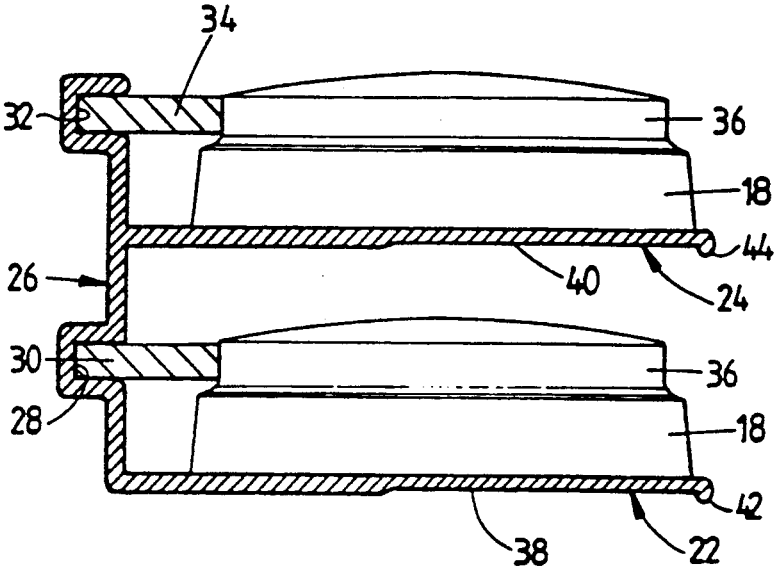
FIG. 3 is a cross-sectional view through the arm showing targets thereon.
Figure 2:
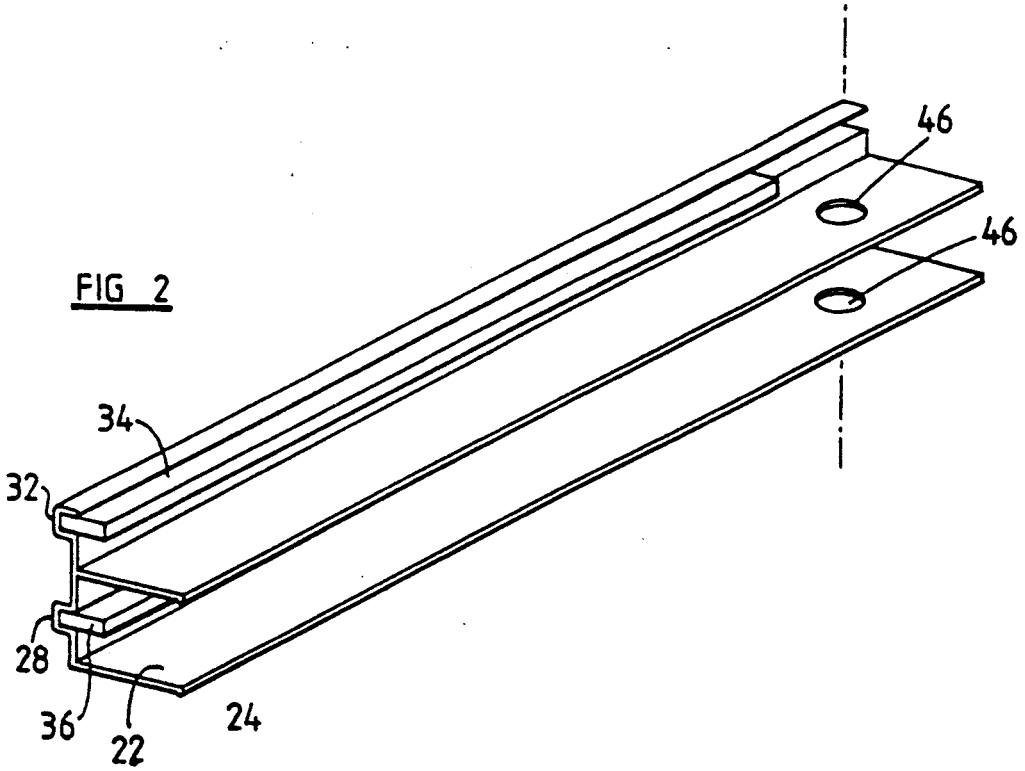
FIG. 2 is a perspective view of a throwing arm of the invention.

The throwing arm 8 of the invention is illustrated in more detail in FIGS. 2 and 3. The arm is preferably formed from extruded aluminium which provides strength and lightness. As best seen in FIG. 3, the arm 8 includes a lower plate 22, upper plate 24 and interconnecting wall 26. The wall 26 is formed with a first recess 28 which receives a rubber strip 30. The upper edge of the wall 26 extends above the upper plate 24 and is formed with a second recess 32 which receives an upper rubber strip 34. The width of the plates 22 and 24 are about 80 mm which is wide enough for targets 18 of standard size to be supported thereon. It will be seen that the targets 18 include a ring portion 36 against which the rubber strips 30 and 32 bear. As the arm is rapidly rotated, the rings 36 engage the strips 30 and 34 and because of the good frictional contact therewith, the targets 18 will roll as they move along the plates 22 and 24. When the targets leave the ends of the arm they will have a spinning motion which assists in obtaining the correct trajectory for the targets.

The outer portions of the plates 22 and 24, that is to say, those parts remote from the wall 26 can be made of thinner wall section than those parts adjacent to the wall section. For instance, the outer parts 38 and 40 may have a wall thickness of say 2 mm whereas the remainder of the extrusion has a wall thickness of say 2.5 mm. The outer edges themselves may be formed with beads 42 and 44 for strengthening the free edges. The beads project downwardly so as not to interfere with the movement of the targets 18 along the plates 22 and 24. The arm 8 is provided with aligned openings 46 for receipt of the shaft 10 of the throwing mechanism 6. The arm is affixed to the shaft by means of bolts or the like (not shown). The arm can be made of any suitable length such as 435 mm, the openings 46 being centered 20 mm from one end. The said one end preferably mounts a counterweight (not shown) which balances the weight attributable to the extra length of the arm and the weight of two clay targets.

In use of the invention, a target 18 can be placed on the upper plate 24 from the magazine 12 and the operator would manually place the target on the lower plate 22. When the mechanism is operated, both of the targets will be ejected by the throwing arm substantially simultaneously. In some circumstances, it is possible to arrange for two targets to be placed on each of the upper and lower plates. The additional targets could be placed manually on the plates 22 and 24. The throwing arm can be used in the target throwing device dislosed in the aforementioned U.S. patent application Ser. No. 542,684.

Figure 4:
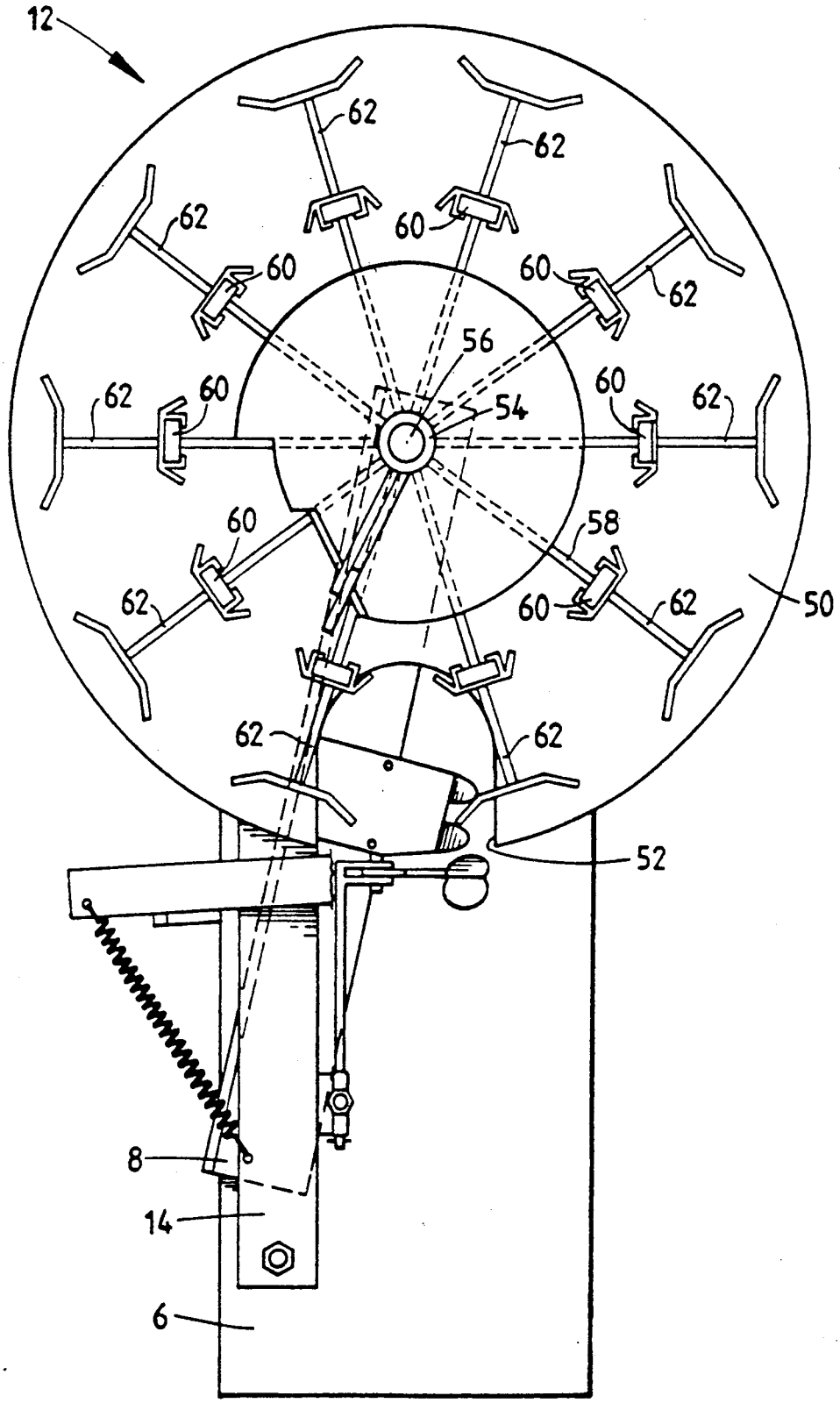
FIG. 4 is a simplified plan view of the target throwing device.
Figure 5:
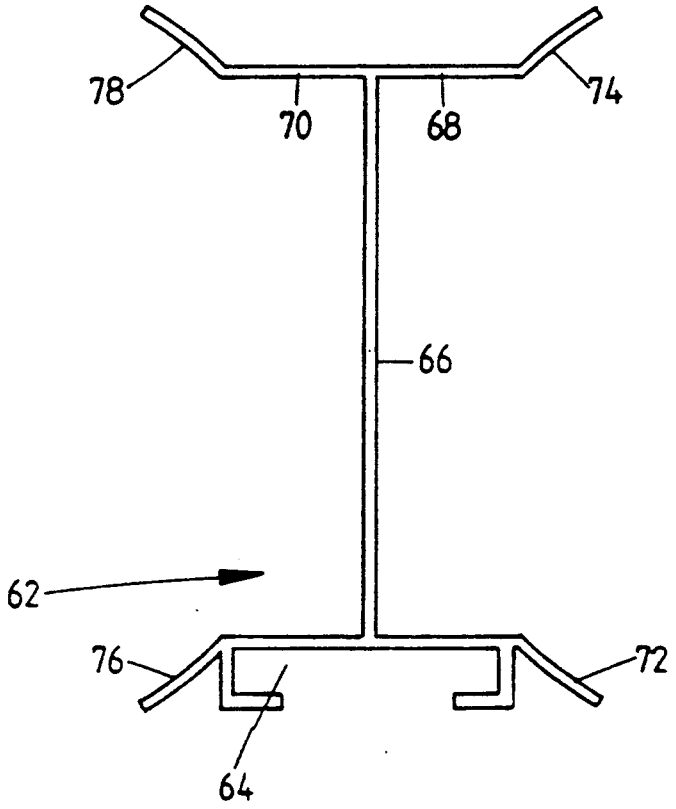
FIG. 5 shows an extrusion of the target magazine.
Figure 6:
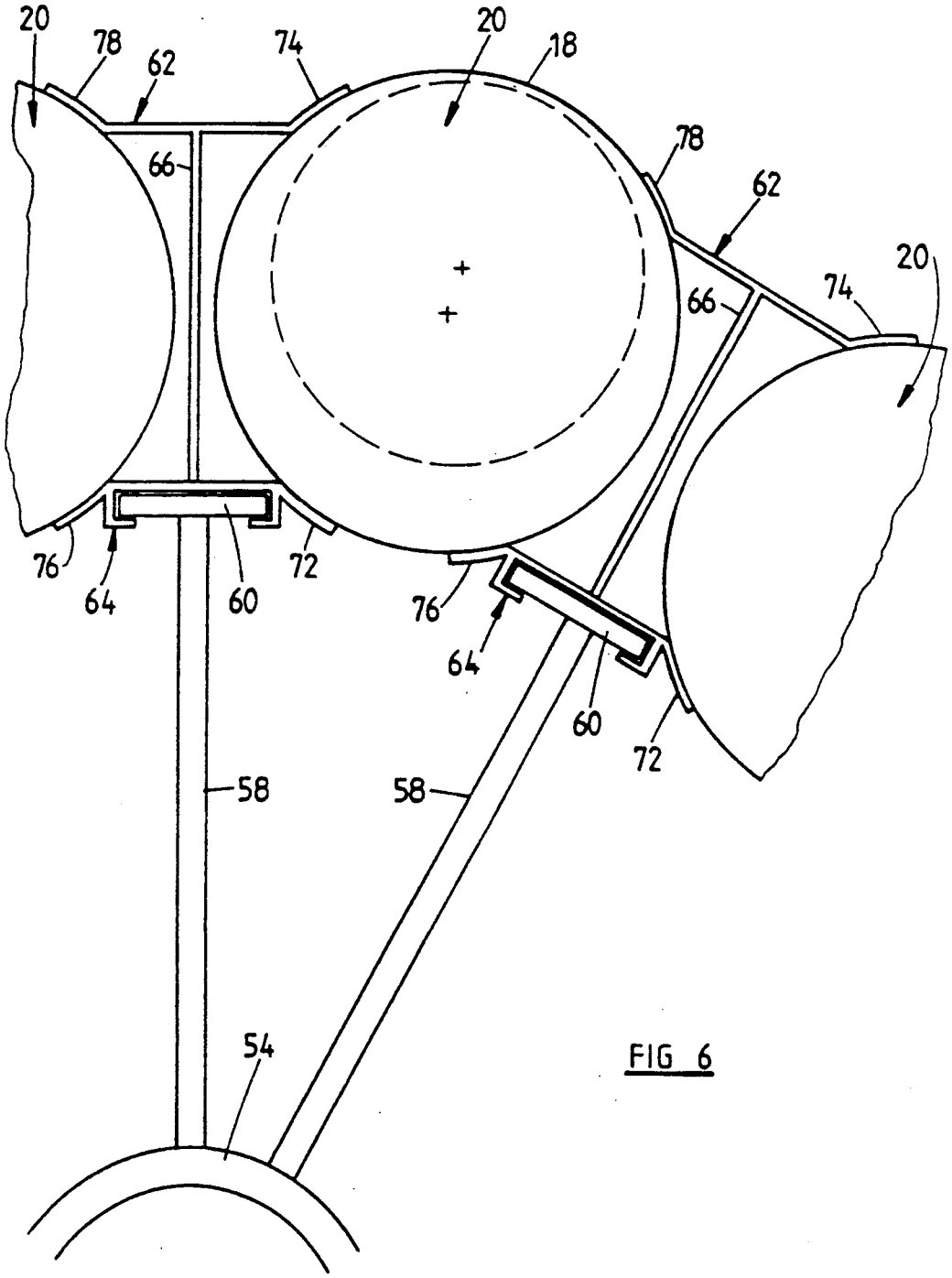
FIG. 6 is a fragmentary plan view illustrating the cooperation of the extrusions with columns of targets.

FIGS. 4 to 6 illustrate in more detail the construction of the preferred form of target magazine 12 in accordance with the invention. The magazine target can be used with the target throwing device disclosed in the aforementioned U.S. patent application Ser. No. 542,684.

The magazine 12 is arranged for rotation about a support plate 50 which is held on the bracket 14. The plate 50 includes a transfer opening 52 for transferring the targets 20 onto the arm 8. The details of this transfer need not be described since they are the same as those described in the aforementioned application. The target magazine includes a hub 54 which is mounted for indexed rotation about a shaft 56 about which the arm 8 is also mounted for rotation. Extending radially outwardly from the hub 54 is a plurality of arms 58 the lower edges of which are adjacent to the plate 50. At or near the ends of each of the arms 58 is an upright bar 60 each of which supports an extruded support element 62. As will be explained hereinafter, the columns of targets are supported between adjacent pairs of the extruded elements 62.

FIG. 5 illustrates in more detail one of the extruded elements 62. The member 62 is preferably extruded aluminium having a wall thickness of about 1.6 mm. It will be seen that it includes a C-shaped channel 64 which snugly receives the bar 60 so that the element 62 is firmly supported by the bar. Part of the arm 58 may extend beneath the extruded element 62 so as to stop the latter moving into contact with the plate 50. Other arrangements may of course be employed to prevent this. The extruded element 62 has a central web 66 having a pair of legs 68 and 70 projecting perpendicularly therefrom. The member 62 includes a first pair of legs located on one side of the web 66. More particularly, a leg 72 extends from the channel 64 and a leg 74 extends from the end of the leg 68. On the other side of the web 68 is a second pair of legs 76 and 78 extend from the channel 64 and leg 70 respectively.

FIG. 6 diagrammatically illustrates columns 20 of targets 18 being supported between adjacent extruded elements 62 of the magazine. It will be noted that the elements 62 are located in position such that the first pair of legs 72 and 74 engage (or nearly engage) the outer peripheries of the targets in the column and the second pair of legs 76 and 78 of an adjacent element 62 also engage (or nearly engage) the targets of the same column. Thus the column of targets is supported between the adjacent elements 62. The same action is repeated around the periphery of the magazine so that all of the columns are supported in the same way.

It is preferred that the legs 72, 74, 76 and 78 have the same curvature as the peripheries of the target 18 although this is not essential.

It will be appreciated that the use of the elements 62 very much simplifies the fabrication of the magazine. Further, it is relatively light and replacement of all or damaged parts is a very simple matter because the extruded elements can readily be replaced. In addition the lengths of the extrusion elements 62 can readily be varied so as to adapt the magazine for different capacities.

Figure 7:
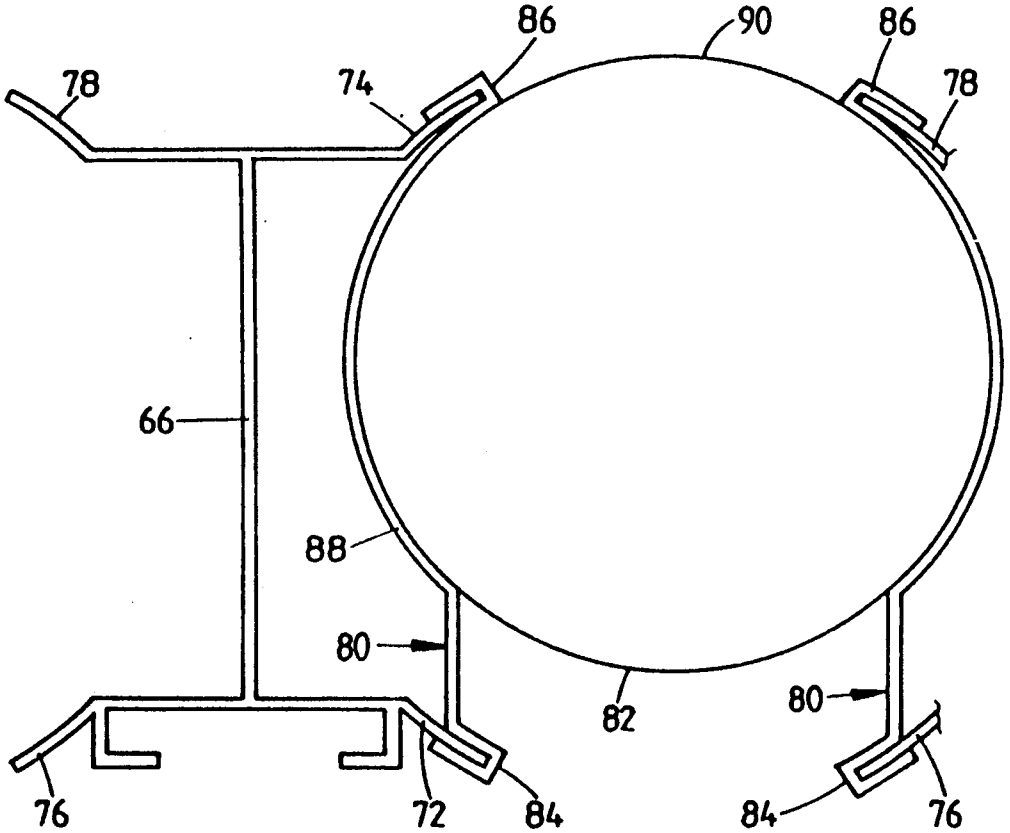
FIG. 7 shows the use of an adaptor for handling smaller diameter targets.

The magazine may be provided with adaptors 80 which make the magazine suitable for use with smaller diameter targets 82, as illustrated in FIG. 7. The adaptors 80 include channel portions 84 and 86 which receive the free ends of the legs 72 and 74 respectively. The adaptor includes a connecting web extending between the channels 84 and 86 and including a part cylindrical portion 88, the diameter of which corresponds to the diameter of the targets to be supported. Each of the members 62 has two adaptors 80 one mounted on its legs 72 and 74 and the other mounted on its legs 76 and 78. The same extrusion is reversed in orientation to enable a length thereof to be mounted on the free ends of the legs 76 and 78. In this way the columns of smaller diameter targets 82 are supported between adjacent adaptors, as diagrammatically illustrated in FIG. 7. The arrangement is preferably such that the outermost point 90 of the targets 82 coincide with the outermost point of the larger diameter targets. This ensures correct operation of the smaller diameter targets with the remainder of the throwing arm.

It is preferred that the legs 72, 74, 76 and 78 are adapted for a standard size target that is to say of normal diameter 110 mm. The adaptors 80 can be arranged to have cylindrical portions 88 which are suitable for supporting targets which are 90 mm or 60 mm in diameter. The adaptors can be extruded or formed from sheet metal.

Figure 8:
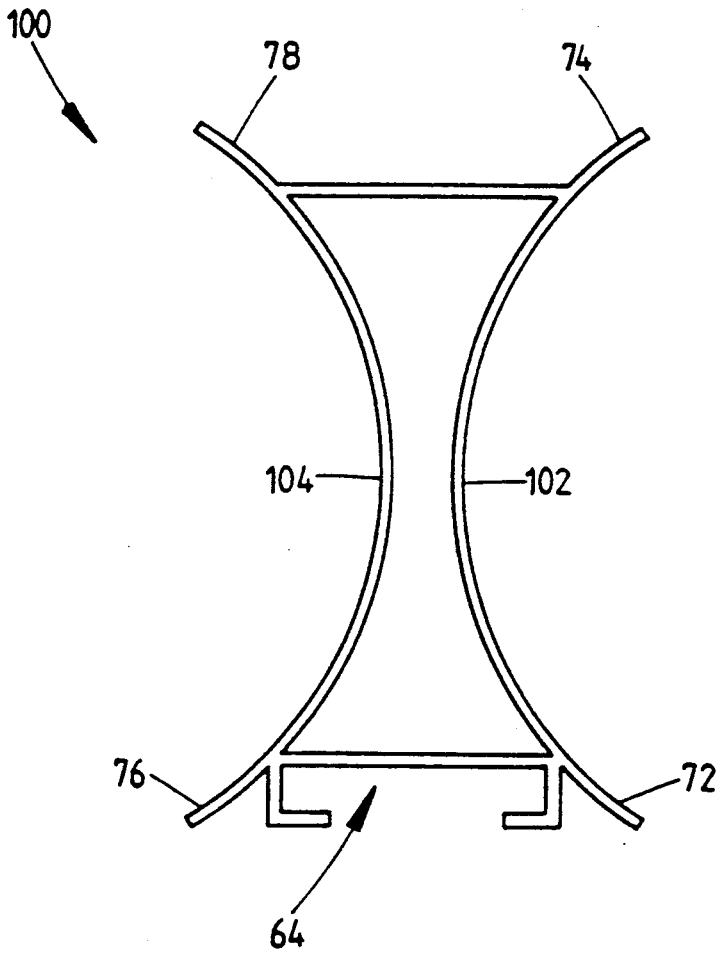
FIG. 8 shows a modified form of extrusion.

FIG. 8 illustrates a modified form of extruded support element 100. It has the C-shaped channel 64 as before and parts which correspond to the legs 72, 74, 76 and 78. The central web 66 is however replaced by a pair of curved web portions 102 and 104 which are respectively contiguous with the cylindrical surfaces of the legs 72, 74 and 76, 78. The element 100 otherwise functions in the same way as the extruded element 62.

Many modifications will be apparent to those skilled in the art without departing from the spirit and scope of the invention.

I claim:

1. A throwing arm for a target throwing device, comprising:

an arm member including:

a first surface for supporting a first target thereon;

a second surface disposed below said first surface for supporting a second target thereon;

a wall member extending between to connect said first and second surfaces;

a first friction member, disposed in a first recess in said wall member above said first surface, for frictionally engaging, in use, a side of the first target; and a second friction member, disposed in a second recess in said wall member above said second surface, for frictionally engaging, in use, a side of said second target;

wherein said first and second surfaces; said first and second recesses and said wall member constitute an integrally formed extrusion.

2. A throwing arm for a target throwing device, comprising:

an arm member including:

a first surface for supporting a first target thereon;

a second surface disposed below said first surface for supporting a second target thereon;

a wall member extending between to connect said first and second surfaces;

a first friction member, disposed in a first recess in said wall member above said first surface, for frictionally engaging, in use, a side of the first target; and a second friction member, disposed in a second recess in said wall member above said second surface, for frictionally engaging, in use, a side of said second target;

wherein said first and second surfaces; said first and second recesses and said wall member constitute an integrally formed extrusion, further comprising first and second plates which project from the wall member, said first and second surfaces respectively being upper surfaces of said first and second plates.

3. A throwing arm as claimed in claim 2 wherein outer regions of said first and second plates are of thinner thickness than inner regions of said plates adjacent the wall member.

4. A throwing arm as claimed in claim 3 wherein edges of the plates are formed with downward projecting beads to improve rigidity.

5. A magazine for a target throwing device comprising:

a plurality of extruded support elements arranged for supporting circumferentially spaced columns of targets in a ring, said elements including a first pair of legs adapted to contact a first column of targets and a second pair of legs adapted to contact a second column of targets adjacent the first column of targets; and means for supporting said elements and for rotation in unison about an axis which passes through the centre of the ring, said supporting means maintaining the positions of the elements such that each column of targets is, in use, supported by the first pair of legs of one support element and the second pair of legs of an adjacent support element, wherein said means for supporting said elements includes a plurality of upright members and wherein said support elements include formations which engage said upright members, wherein said means for supporting said elements includes a plurality of arms radiating from a hub on said supporting means and said upright members comprise bars extending upwardly from the arms, and wherein said formations include a C-shaped channel receiving said bars, respectively, in interlocking engagement.

6. A magazine as claimed in claim 5, further comprising first and second adaptors respectively mounted on said first and second pairs of legs of adjacent support elements, each said first and second adaptor having opposite ends respectively engaging the associated first and second pair of legs and a curvilinear portion respectively extending between the associated first and second pairs of legs.

7. A magazine for a target throwing device comprising:

a plurality of extruded support elements arranged for supporting circumferentially spaced columns of targets in a ring, said elements including a first pair of legs adapted to contact a first column of targets and a second pair of legs adapted to contact a second column of targets adjacent the first column of targets; and means for supporting said elements and for rotation in unison about an axis which passes through the centre of the ring, said supporting means maintaining the positions of the elements such that each column of targets is, in use, supported by the first pair of legs of one support element and the second pair of legs of an adjacent support element, wherein said legs are curved with the same curvature as the targets.

8. A magazine as claimed in claim 7 wherein said first and second legs are interconnected by first and second curved webs respectively.

9. A target throwing device, comprising a base; a throwing mechanism mounted to the base; a magazine mounted to the throwing mechanism and adapted to support at least a first target thereon; and a throwing arm means connected to the throwing mechanism for receiving said first target from the magazine to throw same, said throwing arm means including an arm member having:

a first surface for supporting said first target thereon;

a second surface disposed below said first surface for supporting a second target thereon;

a wall member extending between to connect said first and second surfaces;

a first friction member, disposed in a first recess in said wall member above said first surface, for frictionally engaging, in use, a side of the first target; and a second friction member, disposed in a second recess in said wall member above said second surface, for frictionally engaging, in use, a side of said second target;

wherein said first and second surfaces; said first and second recesses and said wall member constitute an integrally formed extrusion.

* * * * *